US005356014A

United States Patent [19]

Berner

[11] Patent Number: 5,356,014

[45] Date of Patent: Oct. 18, 1994

[54] CONTAINER FRAME FOR USE WITH A PALLET TO FORM A STORAGE AND TRANSPORT CONTAINER

[75] Inventor: Kurt Berner, Muhen, Switzerland

[73] Assignee: Ecoboard Limited, Jersey

[21] Appl. No.: 776,228

[22] PCT Filed: Mar. 26, 1991

[86] PCT No.: PCT/CH91/00074

§ 371 Date: Nov. 12, 1991

§ 102(e) Date: Nov. 12, 1991

[87] PCT Pub. No.: WO91/14631

PCT Pub. Date: Oct. 3, 1991

[30] Foreign Application Priority Data

Mar. 26, 1990 [CH] Switzerland ..... 998/90

[51] Int. Cl.[5] ..... B31B 1/62; B65D 19/00; B65D 5/35

[52] U.S. Cl. ..... 206/600; 206/509; 229/23 R; 493/128

[58] Field of Search ..... 206/600, 509; 229/23 R; 493/128

[56] References Cited

U.S. PATENT DOCUMENTS

| | | | |
|---|---|---|---|
| 2,296,895 | 9/1942 | Bergstein | 229/23 R |
| 2,762,551 | 9/1956 | Fallert | 229/23 R |
| 2,925,210 | 2/1960 | Fallert | 229/23 R |
| 3,443,737 | 5/1969 | Kupersmit | 229/23 R |
| 3,744,702 | 7/1973 | Ellison | 229/23 R |
| 4,019,635 | 4/1977 | Boots | 229/23 R |
| 4,160,519 | 7/1979 | Gorham | 229/23 R |
| 4,252,266 | 2/1981 | Kupersmit | 229/23 R |
| 4,392,606 | 7/1983 | Fremion | 229/23 R |
| 4,655,366 | 4/1987 | Sykes | 229/23 R |

FOREIGN PATENT DOCUMENTS

| | | |
|---|---|---|
| 1566551 | 5/1980 | United Kingdom . |
| 2128589 | 5/1984 | United Kingdom . |

*Primary Examiner*—William I. Price
*Attorney, Agent, or Firm*—Flehr, Hohbach, Test, Albritton & Herbert

[57] ABSTRACT

The container frame (1) is constructed with three layers, the middle layer (3) having a smaller width than the inner and outer layers (2, 4). Insertion slots (5, 6) are thereby formed at the top and bottom of the container frame. A pallet (7) made of carton forming the bottom of the container comprises a base plate (8) and feet (9) made of layers of cardboard, glued to its underside. On the side of the base plate (8) lying opposite the feet (9) is glued a cardboard bottom element (10), whose edges (11) are bent upwards. The insertion slot (6) of the container frame is placed on the bent edge (11). A lid element (12) with bent over edges (13) can be placed in the upper insertion slot (5). All components of the container consist of cardboard or corrugated cardboard and glue and are suitable for recycling.

11 Claims, 5 Drawing Sheets

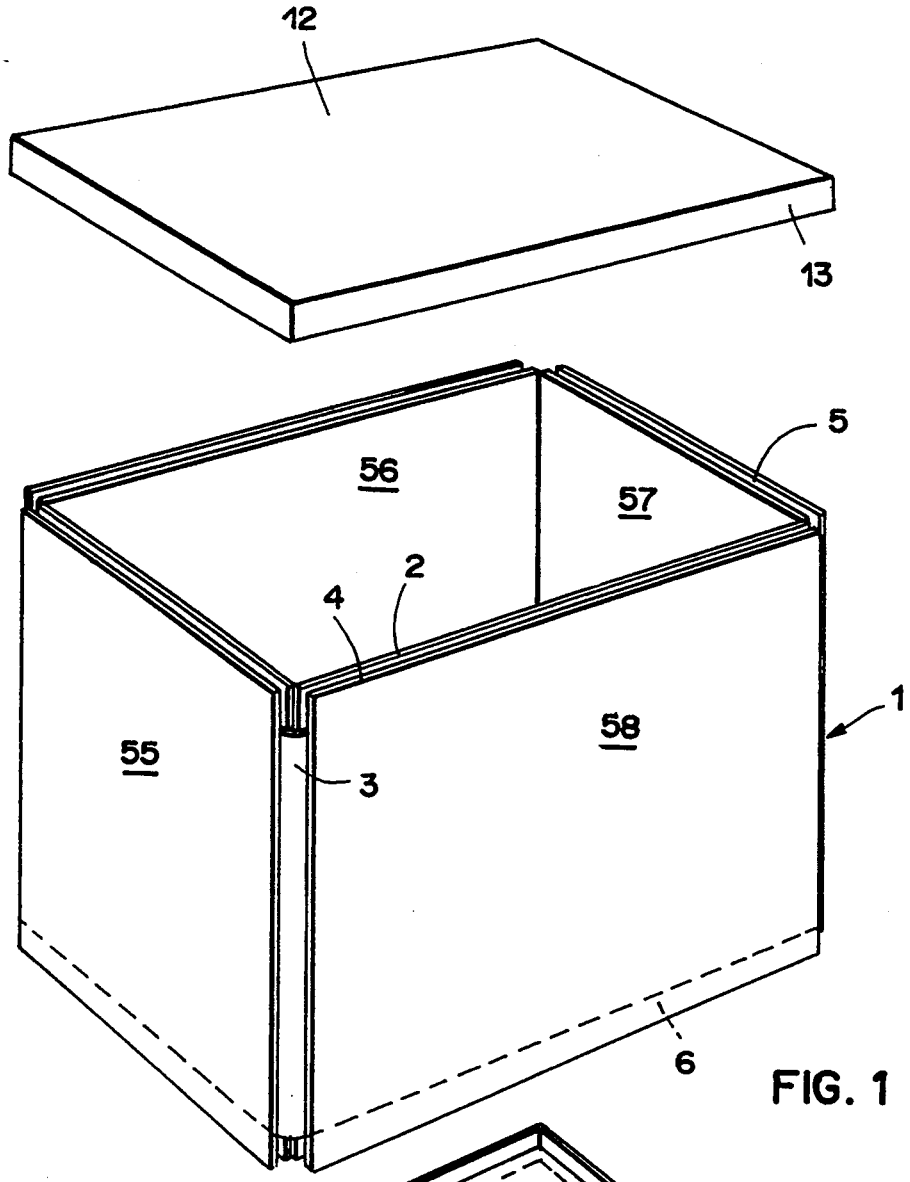
FIG. 1
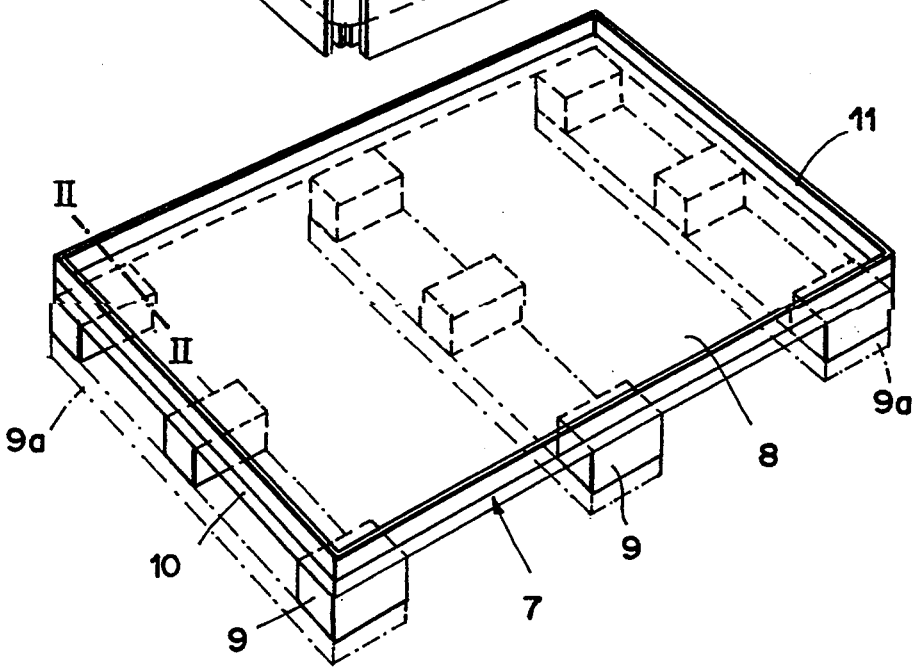

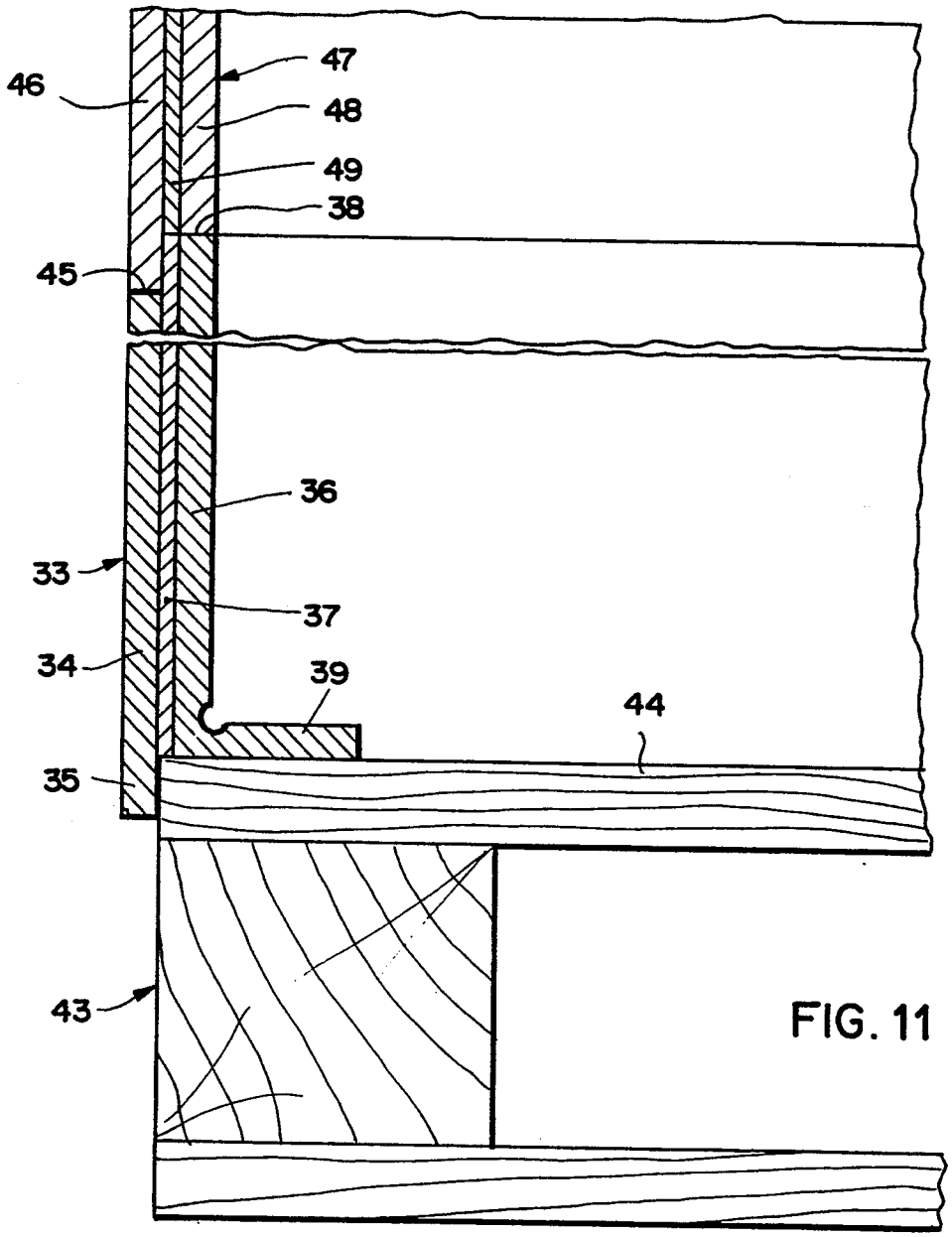
FIG. 11
FIG. 12
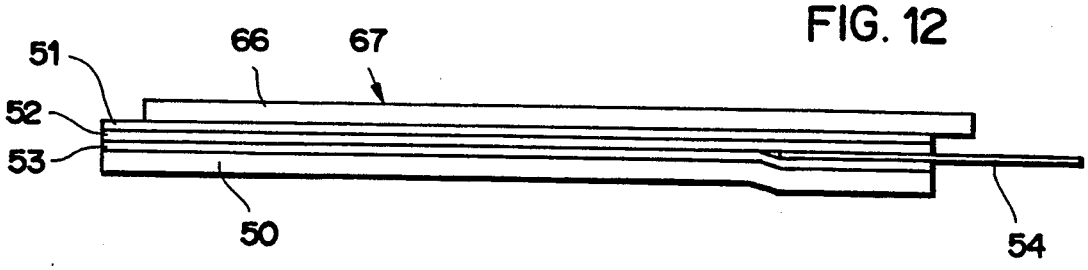

CONTAINER FRAME FOR USE WITH A PALLET TO FORM A STORAGE AND TRANSPORT CONTAINER

BACKGROUND OF THE INVENTION

1. Field of the Invention

This invention concerns a container frame for use with a pallet to form a storage and transport container made from a collapsible blank of recyclable material such as e.g. cardboard or corrugated cardboard. The invention also concerns a pallet and a storage and transport container.

2. Description of Related Art

U.S. Pat. No. 2,762,551 discloses a container having an inner and an outer sleeve. At the lower end a bottom is provided with an edge which is inserted between the two sleeves. Disposed at the top end of the container is a lid which is inserted with side flanges between the sleeves. The container can be made of fibreboard, corrugated fibreboard or any other suitable material. The bottom is placed on a pallet made e.g. of wood, whereupon the inner sleeve is placed on the bottom. The outer container element is then placed on the pallet. The disadvantage of this container is that two individual sleeves must be placed one after the other on the pallet. A separate bottom element is also necessary.

OBJECTS AND SUMMARY OF THE INVENTION

It is therefore an object of this invention to provide a container frame to form a storage and transport container which can be fixed to a pallet by means of simple manipulations. According to the invention, this is achieved by the distinguishing features of claims 1 or 2.

One preferred embodiment should offer the possibility of being able to stack several container frames on top of one another and, if required, closing at the top with a lid. According to the invention, this is achieved by the features of claims 3 and 4.

It is a further object of this invention to provide a pallet for use with a container frame. According to the invention, this is achieved by the features of claim 6.

It is yet a further object of this invention to provide a process for the production of the container of the invention. According to the invention, this is achieved by the features of claim 9.

It is also the object of this invention to provide a storage and transport container of which the container frame may be fixed on a pallet by means of simple manipulations, and which has no parts that cannot be recycled. According to the invention, this is achieved by the features of claim 10.

The three-layer construction renders the container frame very stable and also suitable for large storage and transport containers. Since the container frame consists of cardboard or corrugated cardboard and adhesive, it can be recycled.

Embodiments of the invention and its application will be described in more detail below with reference to the accompanying drawings, in which:

BRIEF DESCRIPTION OF THE DRAWINGS

FIG. 1 is a perspective exploded view of the container frame with pallet and lid.

FIG. 11 is a section view through the container frame and the pallet of the embodiment of FIG. 10;

FIG. 12 is a section through the container frame of a third embodiment of the invention.

DESCRIPTION OF THE PREFERRED EMBODIMENTS

Figure 2:
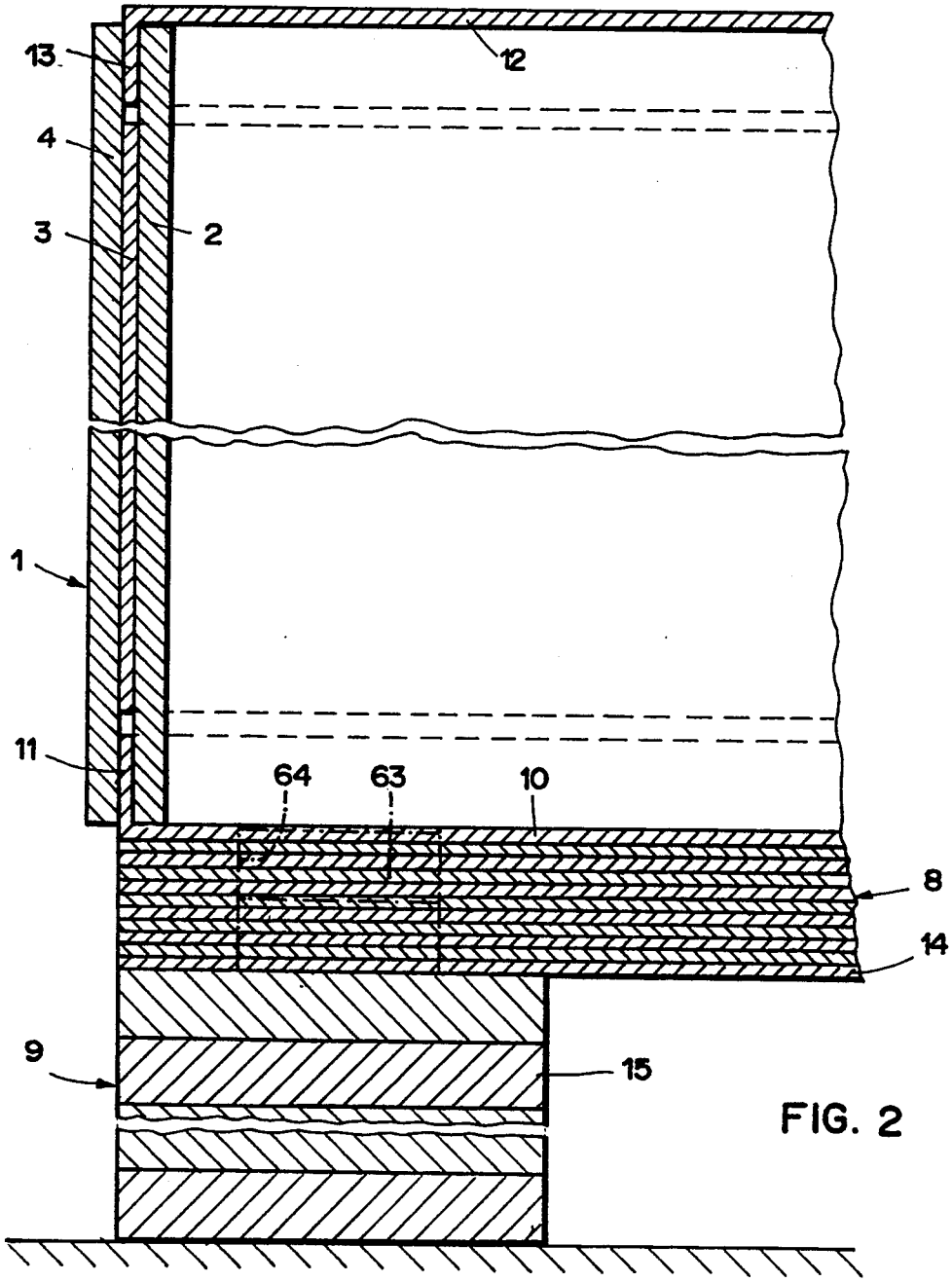
FIG. 2 is a section view along the line II—II of FIG. 1, but showing the container assembled.

The container frame 1 of FIG. 1 is made up of three cardboard layers 2, 3 and 4 which are glued together, the middle layer 3 having a smaller width and thickness than the inner layer 2 and the outer layer 4. The middle layer 3 is set back on both sides from the edge of the inner layer 2 and the outer layer 4 and thereby forms an insertion slot 5 and 6 at the top and bottom of the container wall. The container frame comprises four wall elements 55, 56, 57, 58. A pallet 7, which forms the bottom of the container, comprises a base plate 8 which is glued from individual sheets of cardboard. Glued to the underside of the base plate 8 are nine cardboard foot elements 9, these cardboard foot elements being sawn out of boards which are glued together from several cardboard sheets. Depending on requirements, three board feet 9 at a time can be connected with each other by means of a cardboard strip **9*a* to provide additional reinforcement. Glued to the side of the base plate 8 lying opposite the feet 9 is a bottom element 10, the edges 11 of which are bent upwards. The container frame is placed with its bottom insertion slot 6 onto the edge 11 of the pallet 7. To close the container, a lid element 12 made of cardboard can be inserted into the top insertion slot 5, said lid also having bent over edges 13 like the bottom element 10. A handhole may be contrived in the lid element 12** in order that it may be more easily removed from the container frame.

FIG. 2 shows a section along the line II—II of FIG. 1, although in contrast to FIG. 1, the container frame 1 is in position on the pallet 7 and the lid 13 is placed on the container frame 1. The inner layer 2 and the outer layer 4 of the wall elements consist of glued cardboard and the middle insert layer 3 of reinforced sheet lined cardboard. For one container, four lengthwise and four crosswise wall elements are required, as well as an insert layer made of reinforced sheet lined cardboard. The base plate 8 consists of a cardboard board glued sheet wise from sheets of cardboard 14. The feet elements are sawn out of ten boards 15 glued together. The bottom element 10 glued on the base plate 8 is made of mill board laminated on both sides with highly tear resistant reinforcement paper and is grooved in the edge areas so that the edges 11 can be erected. The lid element 12 is made from the same material and produced in the same manner as the bottom element 10.

The feet elements 9 could be provided with a plug 63 accommodated in an aperture 64 contrived in the base plate 8. A foot element with plug can be produced e.g. by gluing together two additional boards and machining the plug out of the sawn out foot element.

Figure 3:
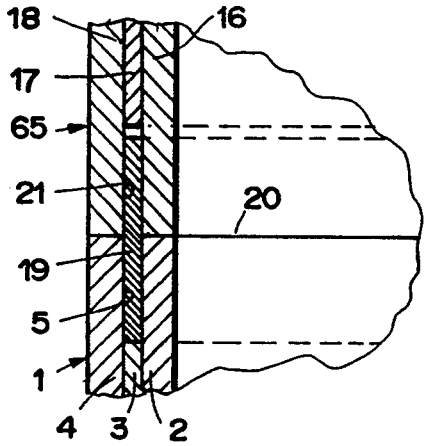
FIG. 3 is a section view in the area of two stacked container frames of FIG. 1.

FIG. 3 shows a section in the upper area of a container frame 1, on which is placed a further container frame 65. The upper container frame 65 is constructed in the same way as the lower container frame 1 and also has sidewalks with three layers 16, 17 and 18. A cardboard belt 19 is inserted into the top insertion slot 5 of the lower container frame 1. The bottom insertion slot 21 of the upper container frame 65 is placed on this cardboard belt 19 which projects above the upper edge 20 of the lower container frame 1. It is possible in this manner to vary the total height of the container. In the same way as illustrated in FIG. 2, a lid element is then placed in the top insertion slot (not shown in FIG. 3).

Figure 4:
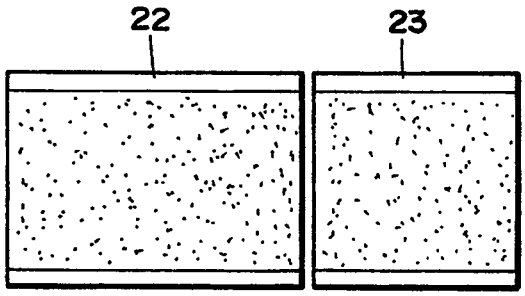
FIG. 4 is a top plan view of crosswise wall elements of the frame of FIG. 1.

With reference to FIGS. 4–9 it will be explained below how the container frame 1 is produced. A first lengthwise and a first crosswise wall element 22 and 23, which are coated on the surface with glue, are placed adjacent to each other and at a distance (FIG. 4).

Figure 5:
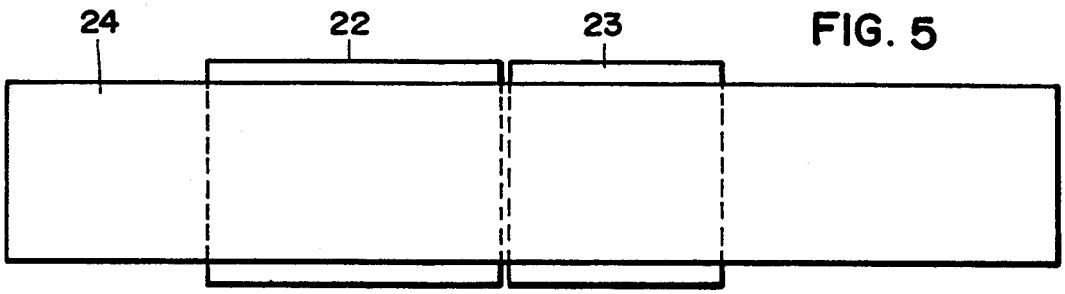
FIG. 5 is a top plan view showing an insert cardboard placed on the upper side of wall elements of the frame of FIG. 1.

An insert cardboard 24 is placed on the upper side, i.e. On the glue coating of the wall elements 22 and 23 (FIG. 5).

Figure 6:
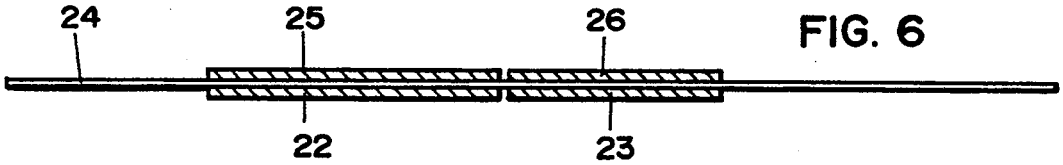
FIG. 6 is a longitudinal section view showing wall elements, crosswise elements and insert cardboards of FIGS. 4–5.

Opposite the wall elements 22 and 23 a second lengthwise and a second crosswise element 25 and 26 with an adhesive coating on the underside are placed on the insert cardboard 24 and glued to the insert board 24 by pressing (FIG. 6).

Figure 7:
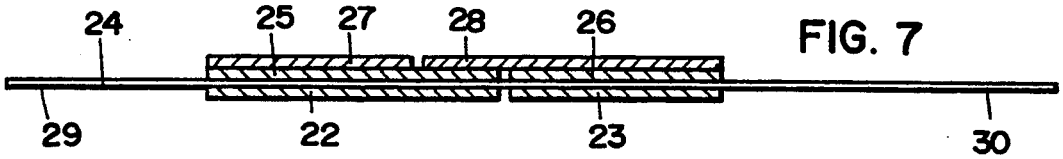
FIG. 7 is a longitudinal section view similar to FIG. 6 with a third crosswise element.

A third crosswise element 27 is placed flush at the outer edge on the lengthwise wall element 25 and a third lengthwise wall element 28 is placed, also flush at the outer edge, on the crosswise element 26, these wall elements 27 and 28 having a coating of glue on their upper surface (FIG. 7).

Figure 8:
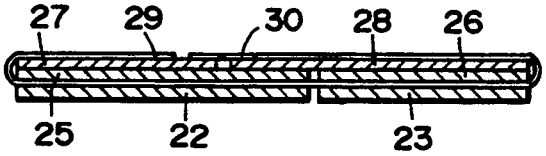
FIG. 8 is a section view illustrating projecting portions of the insert cardboard placed on the wall elements for the frame of FIG. 1.

The projecting portions 29 and 30 of the insert cardboard 24 are placed on the wall elements 27 and 28 (FIG. 8).

Figure 9:
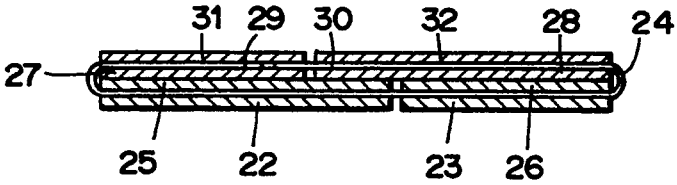
FIG. 9 is a section view similar to FIG. 8 showing a fourth crosswise element and fourth lengthwise element in the frame of FIG. 1.

Opposite the crosswise element 27 and the lengthwise element 28 a fourth crosswise element 31 and a fourth lengthwise element 32 with a layer of glue on their underside are placed on the wrapped around portions 29 and 30 of the insert cardboard (FIG. 9). The superposed wall elements with the insert cardboard running in between are then pressed to achieve good bonding.

FIG. 9 shows the assembled container frame. In this state, the container frames can be stacked and delivered as a packet. The pallets 7 can also be stacked one on top of the other and delivered independently of the container frames. As already mentioned in the comments pertaining to FIG. 2, it is preferable that the dimensions of the pallets and the container frame correspond to the European norm.

The surface of the cardboard for producing the base plate and the feet can be glued with a glue press in order to achieve a certain resistance against the ingress of water. The container frame, the pallet and the lid can be made hydrophobic in a different manner so that they are not softened by rain.

All the components of the container, including the pallet and the lid, consist solely of cardboard or corrugated cardboard, i.e. fibre material and adhesive, and are therefore well suited for recycling, ie. They can be used again to make carton. If the container is defective it can be filled with old fiber material, for example, and processed again to a carton mass. Old, used containers can also be filled with waste for disposal.

Figure 10:
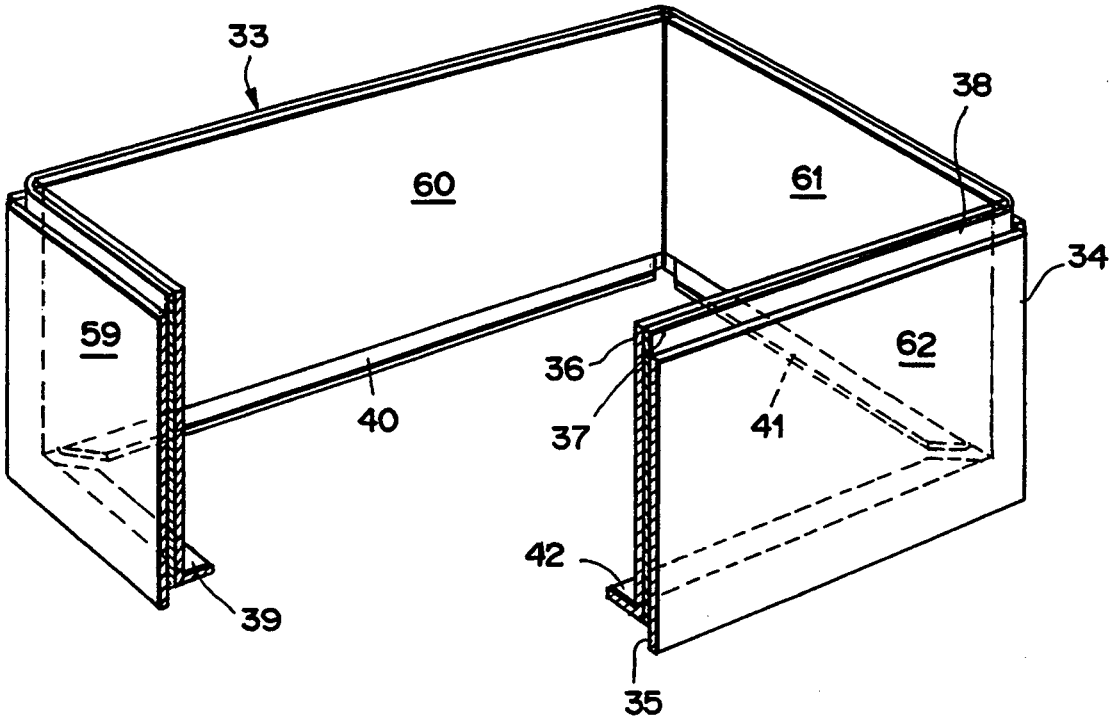
FIG. 10 is a perspective, partially cut away, view of a second embodiment of a container frame.

FIG. 10 is a perspective, partially broken away view of container frame in a second embodiment example. This container frame 33 comprising four wall elements 59, 60, 61, 62 is also constructed with three layers, the three layers being made of cardboard. The frame is produced in the same way as shown in FIG. 4–9 relating to the first embodiment example. The bottom edge 35 of the outer layer 34 projects beyond the middle layer 37. The top edges of the inner and middle layers 36 and 37 are extended beyond the outer layer 34 by the same amount as the bottom edge of the outer layer projects downwards beyond the middle layer 37. At the bottom edge of the container frame 33 the inner layer is extended beyond the middle layer to form a tab, these tabs being bent by 90° and come to rest on the pallet not shown in FIG. 10. Tabs 39, 40, 41 and 42 are cut at an angle of 45° in the corners of the container frame. At the bottom edge of the container frame 33, the elongated edge 35 of the outer layer 34 is placed over the pallet. Another identical container frame or a lid can be placed on the container frame 33.

FIG. 11 is a section through the container frame 33 placed on a wooden pallet 43. The lower tab-shaped edges 39 of the inner layer 36, bent by 90°, are placed on the bottom 44 of the pallet. The lower part 35 of the outer layer 34 extends over the pallet bottom 44 and thus secures the container frame 33 to the pallet 43. The outer layer 46 of a second container frame 47 is placed on the set back edge 45 of the outer layer 34. The inner layer 48 and the middle layer 49 of the upper container frame 47 rest on the upper edge 38 of the inner and middle layers 36, 37 of the lower container frame 33. A lid could also be placed in the same way on the lower container frame 33 or additionally on the upper container frame 47. It is also possible to stack more than two container frames on top of one another. The inner layer 48 of the upper container frame 47 can also be extended to form a tab.

FIG. 12 shows a section through the sidewalk 65 of a container frame 67 of a third embodiment example. As in the second embodiment example, the outer layer 66 is also offset with respect to the middle and inner layer 50. The middle layer consists of three individual layers 51, 52 and 53. The tabs 54 to rest on the pallet bottom are disposed between two layers 52 and 53 of the middle layer and are also bent by 90°, as in the second embodiment example.

In another fourth embodiment example which is not illustrated, the three layers 34, 36 and 37 are equally high at the top edge, although in this embodiment example it is then not possible to stack a second frame. In this case, the edge of the lid was fitted over the outer layer 34.

The second, third and fourth embodiment examples are preferably used when standard wooden pallets are to continue to be used.

While the foregoing embodiments are at present considered to be preferred, it is understood that numerous variations and modifications may be made therein by those skilled in the art and it is intended to cover in the appended claims all such variations and modifications as fall within the true spirit of the invention.

I claim:

1. Container frame for use with a pallet to form a storage and transport container made from a collapsible blank of recyclable cardboard material, characterized in that it comprises wall elements (55, 56, 57, 58) constructed of at least three layers, a middle layer (3) joining the wall elements with each other and having a smaller width than the outer layers (2, 4) and thereby forms an insertion slot (6) at least on one side of the container wall.

2. The container frame of claim 1, characterized in that the middle layer (3) is set back on both sides from the edge of both outer layers (2, 4) and thereby forms a second insertion slot (5) to accommodate a lid (12) or a second container frame (65).

3. Container frame for use with a pallet made from a collapsible blank of recyclable cardboard material, characterized in that it comprises wall elements constructed of at least three layers, a middle layer (37) joining the wall elements (59, 60, 61, 62) with each other and at least the outer layer (34) being offset on at least the bottom side (35) with respect to the inner layer (36, 37) and thereby forms an extended edge (35) on one side of the container frame for fitting over a pallet.

4. The container frame of claim 3, characterized in that at least the outer layer (34) is also offset at the top side (38) with respect to the inner layer (36, 37) and thereby forms a ledge on which another container frame or lid can be stacked.

5. The container frame of claim 3 or 4, characterized in that the inner layer (36) extends beyond the middle layer (37) and forms in the extended portion a bendable tab (39, 40, 41, 42).

6. A pallet for use with a container frame comprised of wall elements constructed of at least three layers, a middle layer joining the wall elements with each other and having a smaller width than the outer layers and thereby forming an insertion slot on at least one side of the container wall, characterized by a pallet bottom (8) and pallet feet (9) made of recyclable cardboard material, the pallet bottom (8) being provided with an extended edge (11) made of cardboard material to be inserted into the slot of the container frame (1).

7. The pallet of claim 6, characterized in that the extended edge (11) is collapsible.

8. The pallet of claim 6 or 7, characterized in that another layer (10) which projects on all sides beyond the pallet bottom, is connected with the pallet bottom (8), the projecting edges (11) forming the collapsible extended edge.

9. Process for producing a container frame for use with a pallet to form a storage and transport container made from a collapsible blank of recyclable cardboard material, characterized in that a first and second lengthwise element (22, 25) and a first and a second crosswise element (23, 26) are glued to each side of the middle layer (24), two lengthwise and two crosswise element lying opposite each other, a third crosswise element (27) being placed with a coating of glue on its upper side on the upper second lengthwise element (25) and a third lengthwise element (28) with a coating of glue on its upper side being placed on the upper second crosswise element (26), the projecting portions (29, 30) of the middle layer (24) being wrapped around and glued to the third elements (27, 28) and a fourth crosswise element (31) and a fourth lengthwise element (32) with a coating of glue on the underside being glued to the middle layer (24) over the third crosswise element (27) and over the third lengthwise element (28) respectively.

10. A storage and transport container with a container frame (1) made from a collapsible blank of foldable, recyclable cardboard material and a bottom, formed from a pallet (7), characterized in that the container frame comprises wall elements (55, 56, 57, 58) constructed of at least three layers, a middle layer (3) connecting the wall elements with each other and having a smaller width than the outer layers (2, 4) and thereby forming an insertion slot (6) at least on one side of the container, and the pallet having a pallet bottom (8) and pallet feet (9) also made of recyclable cardboard material, the pallet bottom (8) being provided with an extended edge (11), made of eg. cardboard material, to insert in the slot (6) of the container frame (1).

11. The container of claim 10, characterized in that the middle layer (3) of the container frame (1) is offset on both sides from the edge of the two outer layers (2, 4) and thereby forms a second insertion slot (5) for accommodating a lid (12) or a second container frame (65).

* * * * *